US010498022B2

(12) United States Patent
Rumpf

(10) Patent No.: US 10,498,022 B2
(45) Date of Patent: Dec. 3, 2019

(54) SYSTEMS AND METHODS INCORPORATING SPATIALLY-VARIANT ANISOTROPIC METAMATERIALS FOR ELECTROMAGNETIC COMPATIBILITY

(71) Applicant: Board of Regents, The University of Texas System, Austin, TX (US)

(72) Inventor: Raymond C. Rumpf, El Paso, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 95 days.

(21) Appl. No.: 15/572,929

(22) PCT Filed: May 11, 2016

(86) PCT No.: PCT/US2016/031729

§ 371 (c)(1),
(2) Date: Nov. 9, 2017

(87) PCT Pub. No.: WO2016/183129

PCT Pub. Date: Nov. 17, 2016

(65) Prior Publication Data

US 2018/0123235 A1 May 3, 2018

Related U.S. Application Data

(60) Provisional application No. 62/160,374, filed on May 12, 2015.

(51) Int. Cl.

| | |
|---|---|
| ***H01Q 1/52*** | (2006.01) |
| ***H01Q 1/24*** | (2006.01) |
| ***H01Q 15/00*** | (2006.01) |

(52) U.S. Cl.

CPC ..... *H01Q 1/521* (2013.01); *H01Q 1/243* (2013.01); *H01Q 15/0086* (2013.01)

(58) Field of Classification Search

CPC ..... H01Q 9/16; H01Q 15/0006; H01Q 15/14; H01Q 19/09; H01Q 1/52; H01Q 1/521

See application file for complete search history.

(56) References Cited

U.S. PATENT DOCUMENTS 8,026,862 B2 * 9/2011 Pendry ..... H01Q 1/245 343/841

2010/0277381 A1 11/2010 Smolyaninov et al.

(Continued)

OTHER PUBLICATIONS

Bedra, Sami, et al; Full-Wave Analysis of Anisotropic Circular Microstrip Antenna with Air Gap Layer; Progress in Electromagnetics Research M; vol. 34; pp. 143-151; 2014.

(Continued)

*Primary Examiner* — Hoang V Nguyen

(74) *Attorney, Agent, or Firm* — Yee & Associates, P.C.

(57) ABSTRACT

Coupling can be reduced between electromagnetic components in system where negative uniaxial metamaterial (MUM) can be utilized between the components and can be configured to reduce coupling. The HUM can be configured in a shape selected according to an electromagnetic field causing the coupling or by calculating a fictitious electrostatic field. An array of electromagnetic components can be decoupled using an array of spatially-variant anisotropic metamaterial. A method for decoupling electromagnetic components can include steps of determining a fictitious electrostatic field surrounding the components disposed in an environment, mathematically transforming the electromagnetic fields into a grating vector function, forming at least one spatially-variant anisotropic metamaterial according to the grating vectors, and inserting the spatially-variant anisotropic metamaterial in the environment in order to decouple the electromagnetic components. Transforming can include scaling the electromagnetic field for use as the grating vector functions.

25 Claims, 14 Drawing Sheets

(56) References Cited

U.S. PATENT DOCUMENTS

| | | | | |
|---|---|---|---|---|
| 2010/0314040 | A1* | 12/2010 | Tyler, II | G02B 1/007 156/278 |
| 2012/0170114 | A1* | 7/2012 | Domash | G02B 1/002 359/359 |
| 2015/0194728 | A1 | 7/2015 | Piau et al. | |

OTHER PUBLICATIONS

Buell, Kevin, et al.,; Metamaterial Insulator Enabled Superdirective Array; IEEE Transactions on Antennas and Propagation; vol. 55; No. 4; pp. 1074-1085; Apr. 2007.

Cummer, Steven, A.,; Full-Wave Simulations of Electromagnetic Cloaking Structures; Physical Review E 74; pp. 1-5; Jul. 26, 2006.

International Search Report for International Application No. PCT/US16/31729; Date of Actual Completion of Search Sep. 21, 2016; dated Oct. 20, 2016; 1 page.

Rumpf, Raymond C, et al.; Synthesis of Spatially Variant Lattices; Optics Express; vol. 20; No. 14; pp. 15263-15274; Jul. 2, 2012.

Written Opinion of the International Searching Authorithy for International Application No. PCT/US16/31729; Date of Actual Completion of Search Sep. 21, 2016; dated Oct. 20, 2016; 5 pages.

* cited by examiner

500

600

700

750

SYSTEMS AND METHODS INCORPORATING SPATIALLY-VARIANT ANISOTROPIC METAMATERIALS FOR ELECTROMAGNETIC COMPATIBILITY

TECHNICAL FIELD

Embodiments are generally related to enhancing electromagnetic compatibility between electromagnetic components, such as antennas. More particularly, embodiments are related to the incorporation of spatially-variant anisotropic metamaterials (SVAMs) in a design for enhancing electromagnetic compatibility within systems containing electromagnetic components.

BACKGROUND

Electromagnetic compatibility in systems, including radio frequency and microwave signal producing hardware (e.g., antennas), often experience interference and signal degradation. Signal degradation occurs because electromagnetic energy produced by independent sources located in close proximity to each other, or other components, can interfere. Such is the case in current cellular phones or microwave arrays that include two or more antennas located in close proximity to one another.

This problem is particularly relevant in the growing mobile device market given the small size and limited space available on wireless mobile devices for locating the antennas needed to support wireless communications with cellular and data networks.

Material properties at radio frequency and microwave scales are limited due to the lack of molecular resonances at these frequencies. The ability to choose, or design, materials in the radio frequency (RF) and microwave regions is therefore limited. By contrast, wide ranges of material options are available at optical frequencies because electron transitions occur on a commensurate time scale.

Metamaterials are engineered composites that exhibit properties often not found in nature and that are not observed in their constituent materials. The most common form of metamaterials use sub-wavelength metal resonators to realize a desired permittivity or permeability. However, such structures are prohibitively lossy for many applications and usually operate over an equally prohibitive bandwidth. All-dielectric metamaterials can exhibit much lower loss than metal structures, but they offer fewer design options because they interact more weakly with an applied wave. While dielectric metamaterials, offer excellent potential to overcome shortcomings associated with metal resonators, the weaker interaction with an applied wave remains a significant hurdle.

Accordingly, there is a need in the art for methods, systems, and devices providing materials and shapes that can be incorporated into electromagnetic, magnetic, radio frequency, microwave, millimeter wave, and other such systems in a manner that enhances the electromagnetic compatibility of components located therein.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is therefore one aspect of the disclosed embodiments to provide a system and method wherein at least one negative uniaxial anisotropic metamaterial can be configured to reduce coupling between components.

It is another aspect of the disclosed embodiments that at least one negative uniaxial anisotropic metamaterial can be configured to reduce coupling between components of a system wherein two or more electromagnetic components are coupled through an electromagnetic field.

It is another aspect of the disclosed embodiments that at least one negative uniaxial anisotropic metamaterial can be configured in a shape selected according to a near field.

It is another aspect of the disclosed embodiments that one or more negative uniaxial anisotropic metamaterials can be configured in a shape selected according to a fictitious electrostatic field.

It is another aspect of the disclosed embodiments that an array of electromagnetic components can be decoupled using an array of negative uniaxial spatially-variant anisotropic metamaterials.

It is yet another aspect of the disclosed embodiments to provide a method for decoupling electromagnetic components that includes determining fictitious electrostatic fields associated with electromagnetic components disposed in an environment, transforming the electromagnetic fields into a grating vector function, forming at least one spatially-variant anisotropic metamaterial according to the grating vectors, and inserting the spatially-variant anisotropic metamaterial in the environment in order to decouple the electromagnetic components.

It is also an aspect of the disclosed embodiments that the step of transforming includes scaling the electromagnetic or electrostatic field for use as the grating vector functions.

It is also an aspect of the disclosed embodiments that determining a better model of the electromagnetic fields associated with the assembly of components disposed in an environment include simulating the environment with the electromagnetic components in order to orient a spatially-variant anisotropic metamaterial for incorporation therein.

It is an aspect of the disclosed embodiments that forming at least one spatially-variant anisotropic metamaterial according to the grating vectors includes defining a shape and a spacing of the at least one spatially-variant anisotropic metamaterial according to the grating vectors.

It is also an aspect of the disclosed embodiments that the spatially-variant anisotropic metamaterial comprises a negative uniaxial spatially-variant anisotropic metamaterial.

The aforementioned aspects and other objectives and advantages can now be achieved as described herein. In one example embodiment, a system can be configured, which includes at least two components coupled through an electromagnetic field and at least one metamaterial configured to reduce coupling between the components. The metamaterial can be spatially-variant to conform around the at least two components and the metamaterial can be a negative uniaxial anisotropic metamaterial. In some example embodiments, the metamaterial can be configured in a shape selected according to an electromagnetic field causing the coupling. In another example embodiment, the metamaterial can be configured in a shape selected according to an electrostatic model using the components causing the coupling.

In some example embodiments, an array of metamaterials can be formed to decouple the at least two components coupled through the electromagnetic field. In some example embodiments, the array of metamaterials can be formed in voids separating the at least two components.

In another example embodiment, a method for decoupling electromagnetic components can be configured, which includes defining a design for at least one metamaterial, forming at least one metamaterial according to at least one grating vector, and inserting the metamaterial in an environment in order to decouple the electromagnetic components.

In another example embodiment, defining a design for at least one metamaterial can include determining an electromagnetic field associated with each of the electromagnetic components incorporated in an environment and transforming the electromagnetic fields into the at least one grating vector. In yet another example, defining a design for at least one metamaterial can involve determining an electrostatic potential.

In another example embodiment, transforming the electromagnetic fields into a grating vector can further involve scaling the electromagnetic field for use as at least one grating vector function.

In yet another example embodiment, steps or operations can be provided for determining an electromagnetic field associated with an assembly of components disposed in the environment and creating an electrostatic model according to the electromagnetic components.

In another example embodiment, forming at least one metamaterial according to the grating vectors can further include defining a shape and a spacing of the at least one metamaterial according to the grating vectors.

In yet another example embodiment, a system can be implemented that includes at least two components coupled through an electromagnetic field, and at least one metamaterial formed in voids separating the at least two components and configured in a shape selected according to an electromagnetic field causing the coupling, in order to reduce the coupling between the components.

BRIEF DESCRIPTION OF THE FIGURES

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

Figure 1:
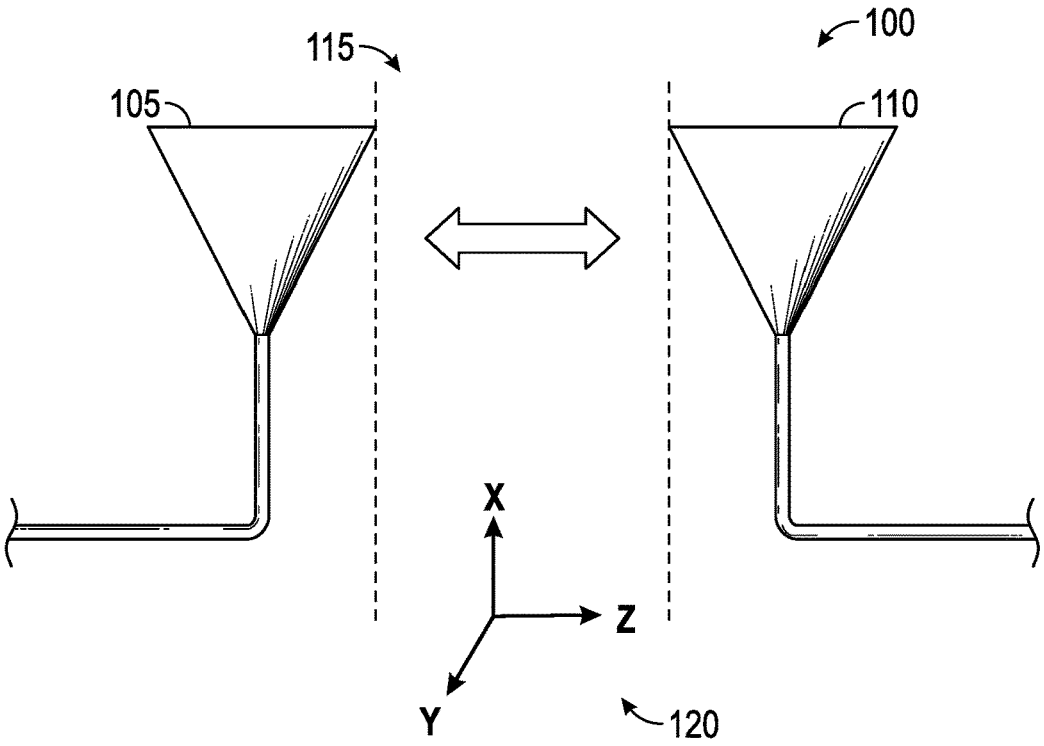
FIG. 1 depicts a diagram illustrating the reduction of coupling between electromagnetic sources, in accordance with an example embodiment.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; example embodiments are provided merely to be illustrative. Likewise, a reasonably broad scope for claimed or covered subject matter is intended. Among other things, for example, subject matter may be embodied as methods, devices, components, or systems. Accordingly, embodiments may, for example, take the form of hardware, software, firmware, or any combination thereof (other than software per se). The following detailed description is therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment, and the phrase "in another embodiment" as used herein does not necessarily refer to a different embodiment. It is intended, for example, that claimed subject matter include combinations of example embodiments in whole or in part.

In general, terminology may be understood, at least in part, from usage in context. For example, terms, such as "and," "or," or "and/or" as used herein may include a variety of meanings that may depend, at least in part, upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be utilized to describe any feature, structure, or characteristic in a singular sense or may be utilized to describe combinations of features, structures, or characteristics in a plural sense. Similarly, terms such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Electromagnetic fields, particularly the near-field or reactive field, surrounding devices can be arbitrarily sculpted to avoid coupling by embedding the devices in a spatially-variant anisotropic metamaterial (SVAM). SVAMs are low loss because they do not have to contain metals and are extraordinarily broadband, working from DC up to a cutoff where they become resonant. In the embodiments disclosed herein, SVAMS can be designed according to their dispersion and anisotropy, to manipulate polarization, stealth, mode transformers, wavefront reversal, and more. This, however, requires very complex geometries that cannot be realized by conventional methods.

3D printing is poised to revolutionize manufacturing and transform the way electronics and electromagnetic devices are designed and manufactured. It offers the ability to arbitrarily form different materials into three dimensional structures with high precision. This provides a means to break away from traditional planar designs and utilize the third dimension like never before. More functions can be fit into the same amount of space, products with novel form factors can be more easily manufactured, interconnects can be routed more smoothly, interfaces can be better implemented, electrical and mechanical functions can be co-mingled, and entirely new device paradigms can be achieved. The presently disclosed embodiments may be realized by developing designs via computer models, and then creating materials from those designs using 3D printing or other forms of digital manufacturing.

The departure from traditional planar topologies, however, creates many new problems like signal integrity, cross-talk, noise, and unintentional coupling between devices. The embodiments disclosed herein make use of 3D SVAMs to sculpt the shape of electromagnetic fields in order to address the problems associated with traditional electronic designs.

The degree to which fields can be sculpted by SVAMs depends on the strength of the anisotropy, or birefringence, and how well the orientation can be spatially varied, or functionally graded. The embodiments take advantage of engineered composites composed of a periodic lattice of physical features that interact with the electromagnetic field to provide new and useful properties, known as metamaterials. The metamaterials disclosed herein can provide very strong birefringence and, combined with 3D printing or other digital manufacturing, provide a mechanism for spatially varying the orientation of the anisotropy. The SVAMs described herein are preferably all-dielectric and are therefore composed of very low loss materials. In some embodiments, the SVAMs can even be monolithic, making use of only air as the second material. Further, the SVAMs are non-resonant so they are extraordinarily broadband, working from DC up to a cutoff where the structure becomes resonant.

The example embodiments disclosed herein use negative uniaxial, spatially-variant anisotropic metamaterials based on planar gratings to facilitate electromagnetic compatibility between electromagnetic components. The gratings are preferably planar, but may also be formed in other shapes as required in specific applications. The gratings can be spatially-varied such that they conform around the components in a device. One preferred procedure is to derive their shape from a fictitious electrostatic field.

Example embodiments herein are inspired by transformation optics. Transformation optics is a coordinate transformation technique. In the embodiments disclosed herein, a coordinate transform can be defined that "bends," "stretches," or otherwise "deforms" space in some desired manner. The coordinate transform can then be applied to Maxwell's equations. Initially the math of the coordinate transform resides in the spatial coordinates, but it is possible to remove the math from the spatial coordinates and move it to the material parameters; specifically, permittivity and permeability. This can then be used to design systems of anisotropic metamaterials with shapes that can be utilized to decouple interfering electromagnetic fields.

FIG. 1 illustrates a situation where two electromagnetic sources, source 105 and source 110, are placed in close proximity to one another, in accordance with an example embodiment. This configuration can produce undesired electromagnetic coupling and may degrade performance of one or both of the sources 105 and 110. In many applications, such as mobile devices or other electronic or magnetic devices, the physical distance that separates the sources may be limited by the size of the device and the configuration of its components. In the example shown in FIG. 1, the physical distance 115 between source 105 and 110 is illustrated. In the example embodiments disclosed herein, the electromagnetic coupling between the sources 105 and 110 can be reduced without physically moving them further away from one another.

To accomplish this, a coordinate transform must be first defined. In the example shown in FIG. 1, it is only desired to stretch the z-axis 120 of the fields created by source 105 and source 110 by some factor a, without physically moving the sources 105 and 110. The transformed coordinates (x', y', and z') are related to the original coordinates (x, y, and z) according to equations (1), (2), and (3) as follows:

$$x'=x \tag{1}$$

$$y'=y \tag{2}$$

$$z'=z/a \tag{3}$$

Let the original system have a background permeability and permittivity as provided by equation (4).

$$[\mu]=\begin{bmatrix}\mu & 0 & 0\\ 0 & \mu & 0\\ 0 & 0 & \mu\end{bmatrix}\ \text{background permeabiltiy} \tag{4}$$

$$[\varepsilon]=\begin{bmatrix}\varepsilon & 0 & 0\\ 0 & \varepsilon & 0\\ 0 & 0 & \varepsilon\end{bmatrix}\ \text{background permittivity}$$

After applying the coordinate transform to Maxwell's equations and moving it to the constitutive parameters [μ] and [ε], the resulting permeability and permittivity tensors are given by Equation (5).

$$[\mu']=\begin{bmatrix}\mu a & 0 & 0\\ 0 & \mu a & 0\\ 0 & 0 & \mu/a\end{bmatrix} \tag{5}$$

-continued $$[\varepsilon'] = \begin{bmatrix} \varepsilon a & 0 & 0 \\ 0 & \varepsilon a & 0 \\ 0 & 0 & \varepsilon / a \end{bmatrix}$$

Thus, the permeability and permittivity are highest in the x and y directions and lowest in the z direction 120. This configuration is called negative uniaxial anisotropy. In the embodiments disclosed herein, negative uniaxial anisotropy can be utilized to replicate the effect of moving the components, such as source 105 and source 110, further away from one another in the z-axis 120. Correctly oriented negative uniaxial materials can thus be used to electromagnetically "stretch" the z-axis 120 by some amount.

Figure 2:
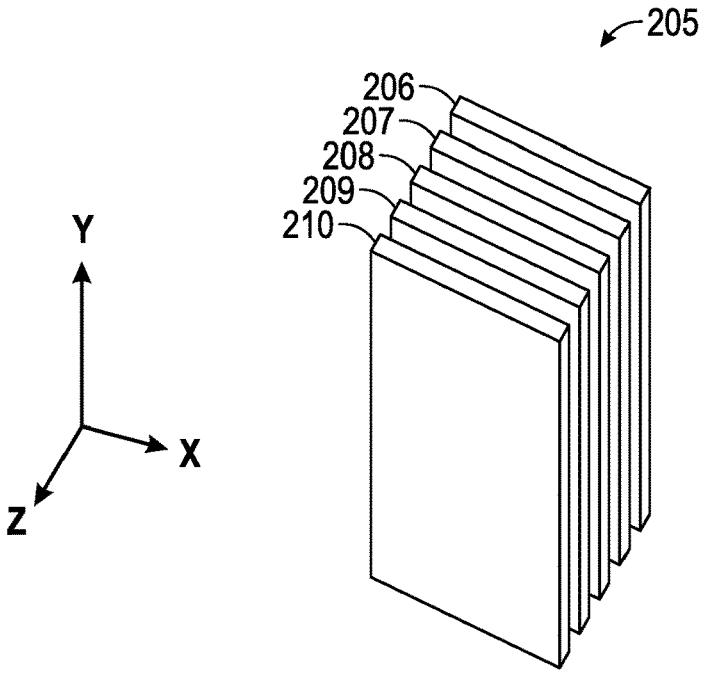
FIG. 2 depicts an embodiment of the basic geometry of a negative uniaxial metamaterial, in accordance with an example embodiment.

Metamaterials are composite materials that interact with an applied electromagnetic field. In the embodiments disclosed herein, metamaterials can be utilized to provide desired material properties. In an exemplary embodiment, a simple negative uniaxial metamaterial 205 is illustrated in FIG. 2. It is constructed of an array of slabs 206, 207, 208, 209, and 210 with alternating electromagnetic material properties.

In order for this negative uniaxial metamaterial 205 to act like a negative uniaxial metamaterial, the spacing from plane-to-plane of slabs 206-210 must be sufficiently less than the wavelength of the signal to avoid any resonant phenomenon. This is typically one quarter of the wavelength or less, but can vary depending on design considerations.

Figure 3:
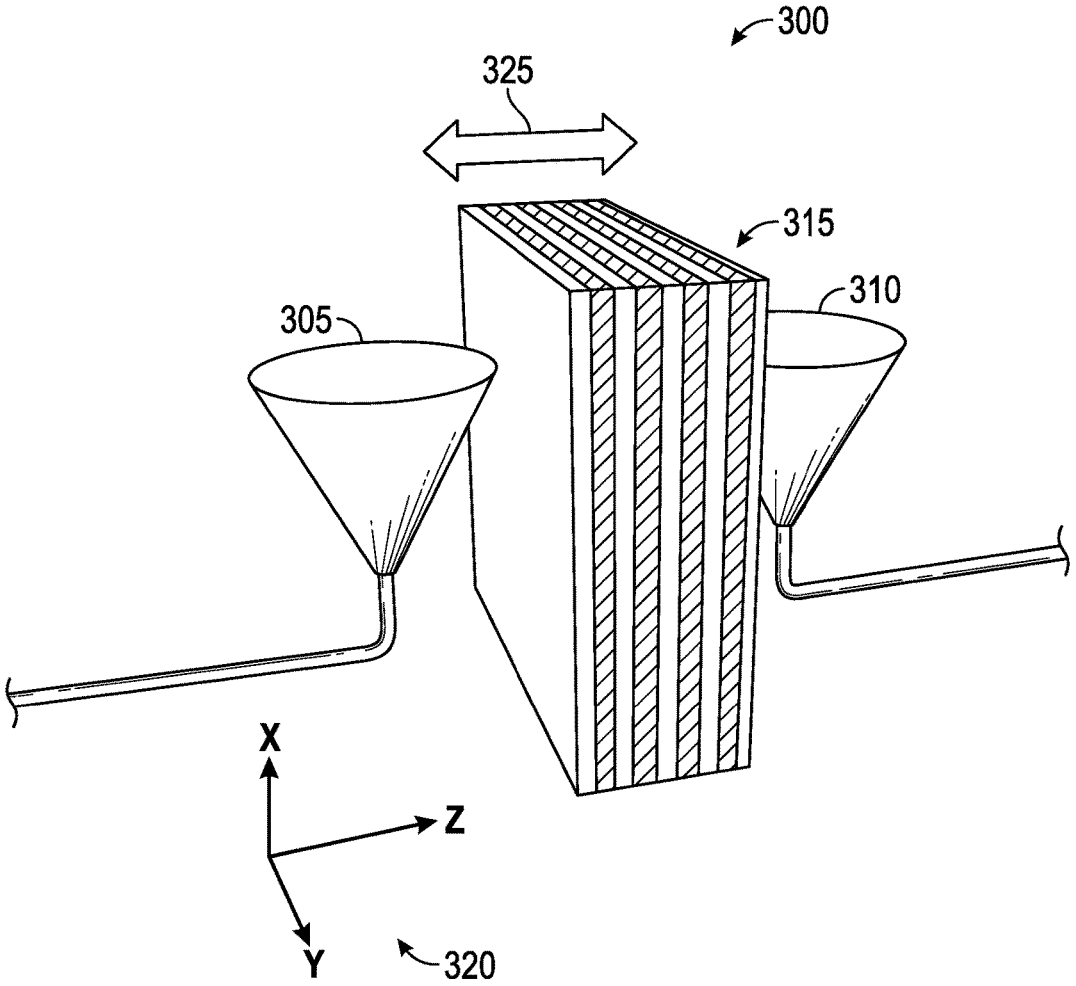
FIG. 3 depicts insertion of a metamaterial to reduce coupling in accordance with an example embodiment.

FIG. 3 illustrates an example embodiment 300 of a system used to decouple electromagnetic sources 305 and 310. In the system 300, the slabs 315 decouple electromagnetic source 305 and 310 (in this case source 305 and source 310 are antennas) using negative uniaxial metamaterials. The planes of slabs 315 are perpendicular to the z-axis 320, which is the direction separating the source 305 from source 310 as illustrated by arrow 325.

It should be understood that any set of electromagnetic components might alternatively be separated by this method and antennas have been selected only for illustrative purposes. Further embodiments include other components where performance degradation may occur as a result of coupling. Such components might be a microwave filter, inductor, battery, a heat sink, signal traces, etc. Thus, in one embodiment alternating layers of planes can be formed between two components in order to electromagnetically decouple the components.

Figure 4:
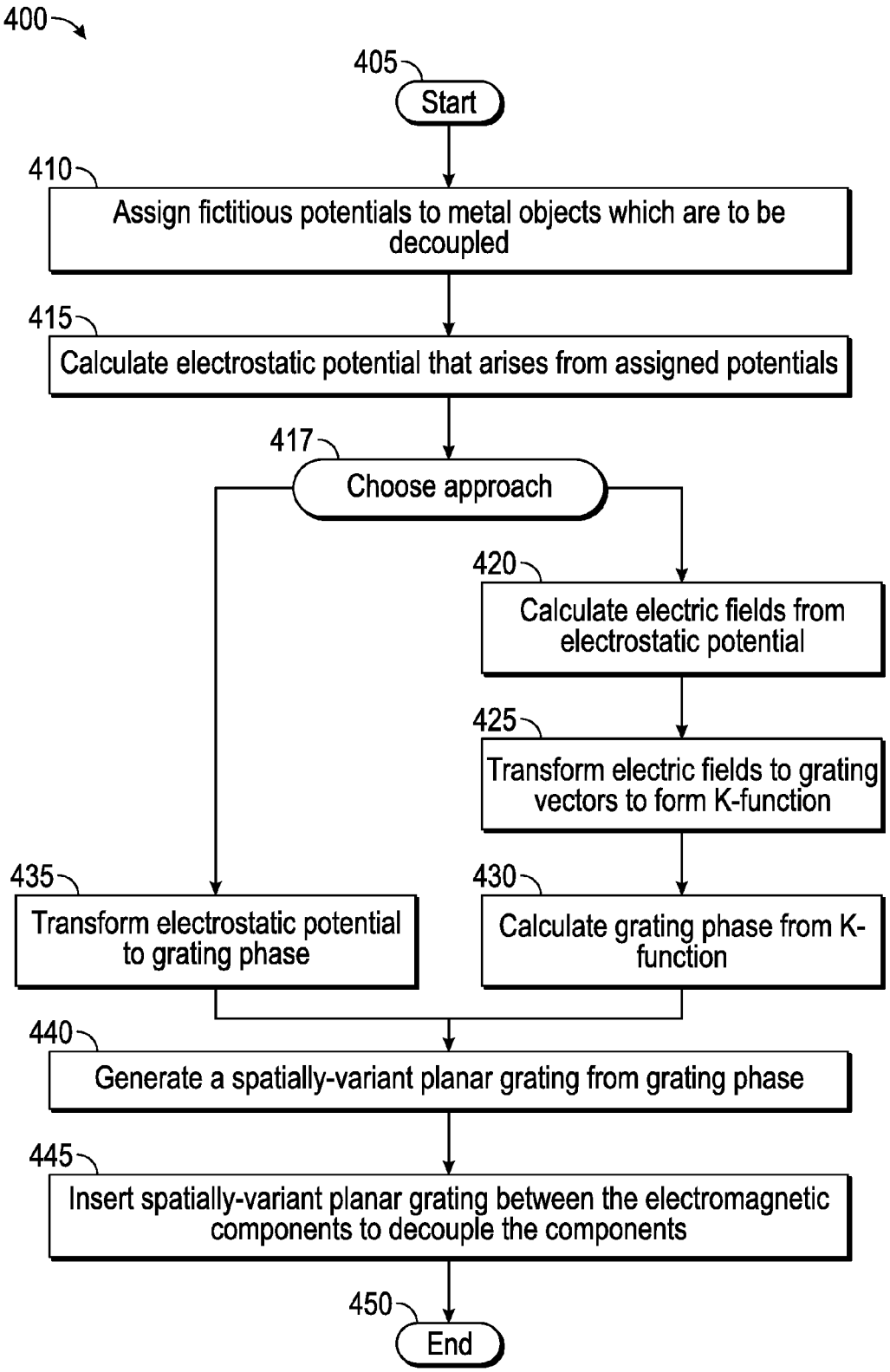
FIG. 4 depicts a flow chart of operations depicting operational steps of a method for reducing coupling between components in accordance with an example embodiment.

In order to optimize this concept and apply it to situations with two (or potentially more) interfering components, a method 400 illustrated in FIG. 4 can be utilized. The method begins as indicated at block 405. As depicted next at block 410, fictitious potentials can be assigned to the objects intended to be decoupled. Next, as shown at block 415 the electrostatic potential that arises from the assigned potentials around the objects can be calculated. As illustrated by block 417, an alternative processes become possible at this point.

In one embodiment, as indicated at block 420, the electric field from the electrostatic potential can be calculated. The electric fields can be transformed to grating vectors, and then as described at block 425, a spatially-variant planar grating can be used to form the K-function. As shown at block 430, the grating phase can be calculated from the K-function.

In another embodiment, the method proceeds from block 417 to block 435 where the electrostatic potential is transformed directly to the grating phase. It should be understood that according to this alternative embodiment, the electric potential itself can be rescaled and used as the grating phase. In this embodiment, the SVAM can be generated directly from the fictitious scalar potential V as cos(aV) where V is scaled by some constant a in order to control the number of planar gratings generated within that space. The resulting SVAM may not be of as high quality, but this alternative embodiment may be faster and more efficient, and therefore preferred in certain circumstances where speed and efficiency are necessary.

In either embodiment, the method proceeds to block 440 where a spatially-variant planar grating, the shape of which is determined according to the grating phase, is generated. The grating can be fabricated (e.g., using 3D printing or other such digital manufacturing technique) and installed between the real objects, as shown at block 445. The method then ends as illustrated at block 450.

Figure 5:
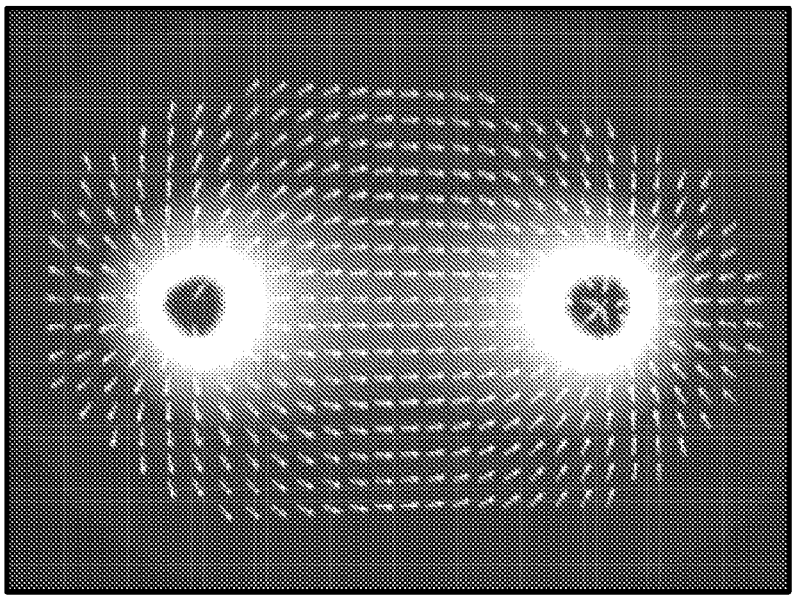
FIG. 5 depicts an electrostatic field between point sources in accordance with an example embodiment.

The steps of method 400 can be further understood according to the following description. First, the objects that are to be decoupled can be assigned electrostatic potentials and the electrostatic field between the objects is calculated through simulation. Such a simulation may be performed using a computer and computer program or other such device. The result 500 from this simulation for a two-object scenario is illustrated in FIG. 5.

An algorithm can be utilized to generate spatially-variant lattices and planar gratings from the simulated electrostatic field 500. A planar grating can be described by a grating vector K, which is always perpendicular to the planes of the grating. They have a magnitude that is $2\pi$ divided by the spacing between adjacent planes. In this manner, the grating it represents can be calculated according to equation (6).

$$\nabla\Phi(\vec{r}) = K(\vec{r})$$

$$\varepsilon(\vec{r}) = \varepsilon_{avg} + \Delta\varepsilon \cos[\Phi(\vec{r})] \tag{6}$$

Figure 6:
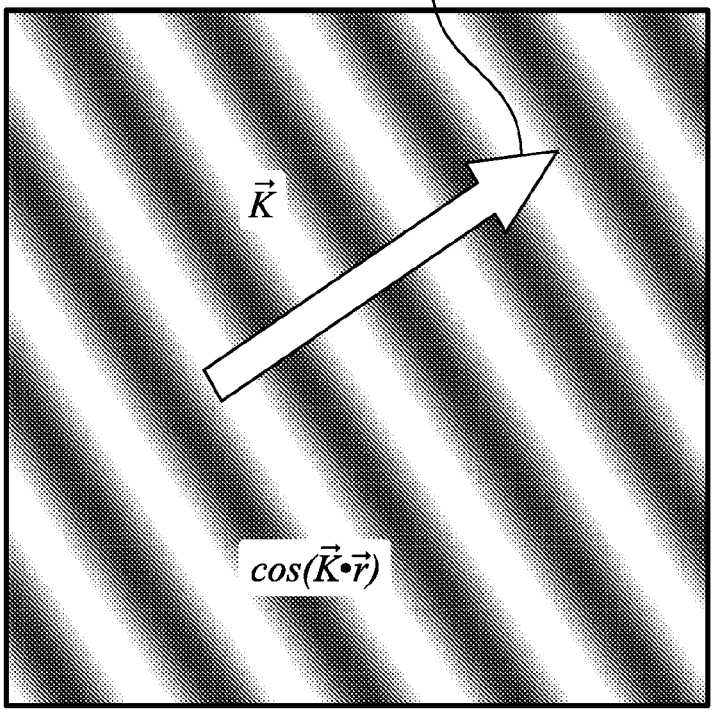
FIG. 6 depicts an exemplary planar grating and its grating vector in accordance with an example embodiment.

A sample planar grating 600 and its grating vector function 605 are illustrated in FIG. 6. It should be appreciated that the planar grating 600 and grating vector function 605 will be dependent on the applicable electrostatic or other such field. As such, the planar grating 600 and grating vector 605 are only illustrative and not meant to limit the scope of the invention.

Next, the fictitious electric fields calculated from the electrostatic simulation are used to develop equivalent grating vectors. This requires that their amplitude be discarded and replaced with the amplitude of an appropriately designed negative uniaxial metamaterial. This can be done according to Eq. (7).

$$\vec{K}(x, y, z) = \frac{2\pi}{\Lambda} \frac{\vec{E}(x, y, z)}{|\vec{E}(x, y, z)|} \tag{7}$$

Figure 7A:
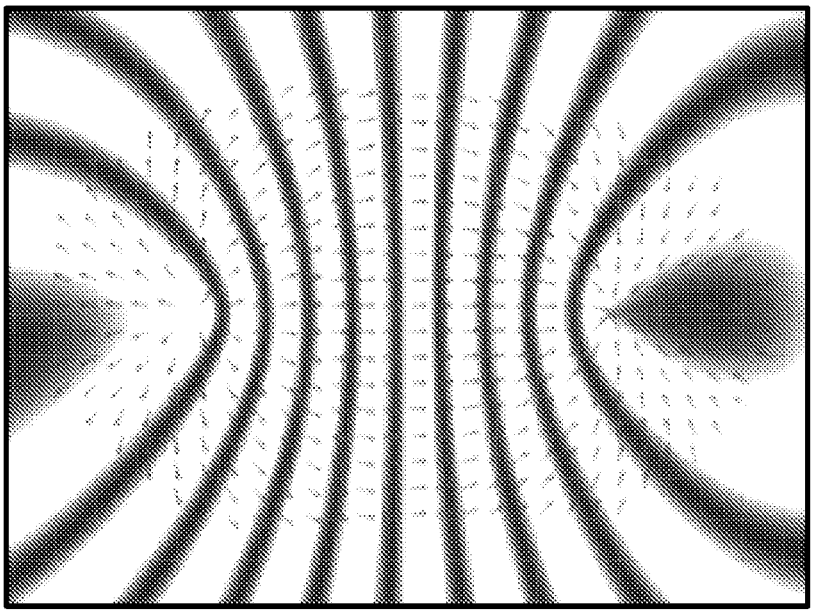
FIG. 7A depicts the shape of a spatially-variant uniaxial metamaterial generated according to the embodiments disclosed herein, in accordance with an example embodiment.
Figure 7B:
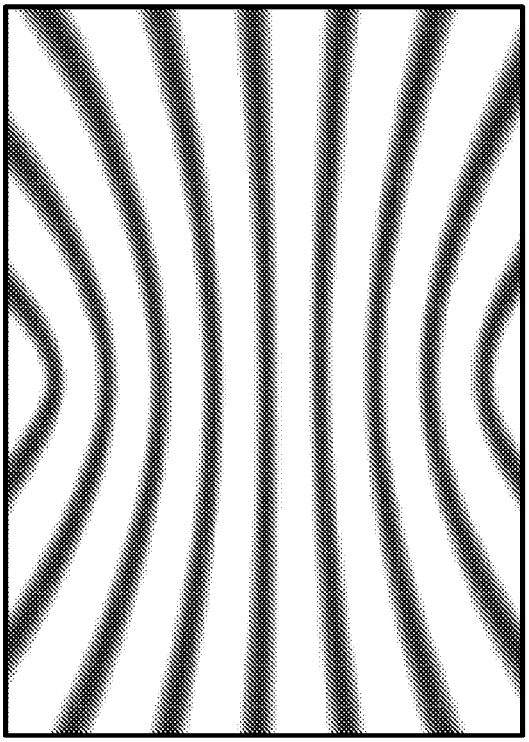
FIG. 7B depicts the shape of an spatially-variant uniaxial metamaterial between sources given the fictitious electrostatic field, in accordance with an example embodiment.

Given the K-function calculated in equation (7), a spatially-variant planar grating can be generated. The spatially-variant planar grating for the two point sources shown in FIG. 5 is illustrated in FIGS. 7A and 7B. FIG. 7A shows the shape 700 of the spatially-invariant anisotropic metamaterial given the K-function for a two point source. FIG. 7B shows shape 750, which is the same shape 700 extracted from the space between the two point sources, which is the valuable part of the shape for purposes of decoupling the sources.

Figure 8:
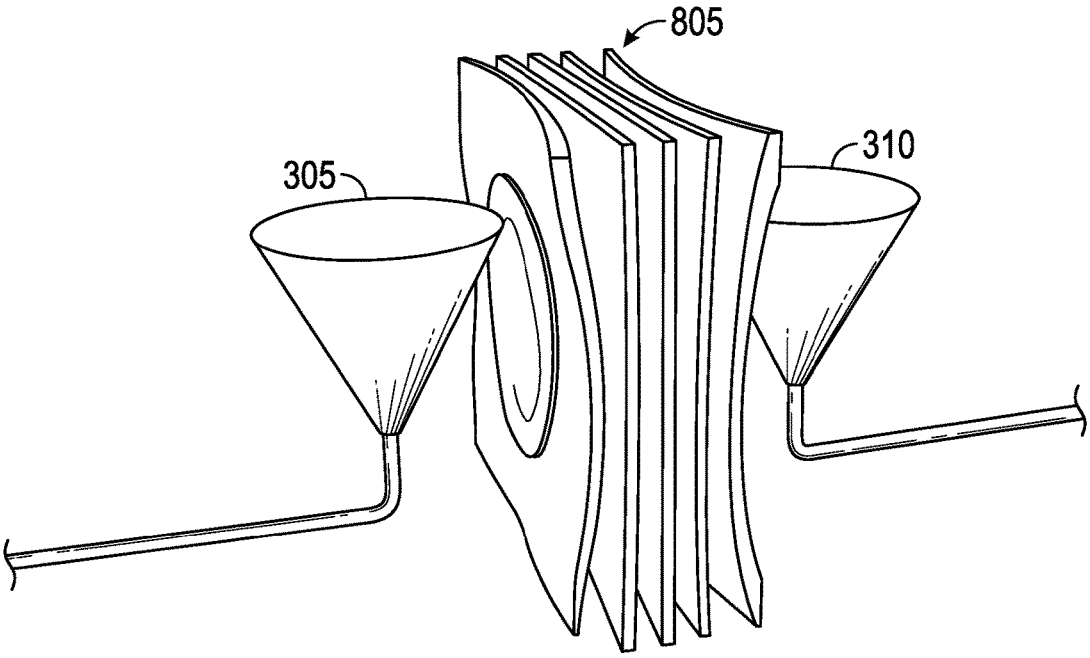
FIG. 8 depicts a 3D system for reducing coupling between sources in accordance with an example embodiment.

FIG. 8 illustrates a spatially-variant planar grating 805 derived from the shape 750 shown in FIG. 7B, inserted between source 305 and source 310. Again, it should be understood that the representation shown in FIG. 8 is based on two sources 305 and 310, which are in this case antennas, but any number of electromagnetic components could be equivalently evaluated such that one or many different spatially-variant anisotropic metamaterial shapes would be derived and inserted between the sources. FIG. 8 is provided for illustrative purposes only and is not meant to limit the scope of the invention.

In one example embodiment, the methods and systems disclosed herein can be utilized to decouple electric or magnetic field producing elements in any electric, magnetic, or electromagnetic device. Similarly, such methods and systems can be utilized to decouple electric or magnetic field producing elements in distinct electric, magnetic, or electromagnetic devices. For example, in an embodiment, the negative uniaxial metamaterial can be directly incorporated between electromagnetic elements in a radio, cell phone, tablet computer, smartwatch, computer, or other such device.

Figure 9:
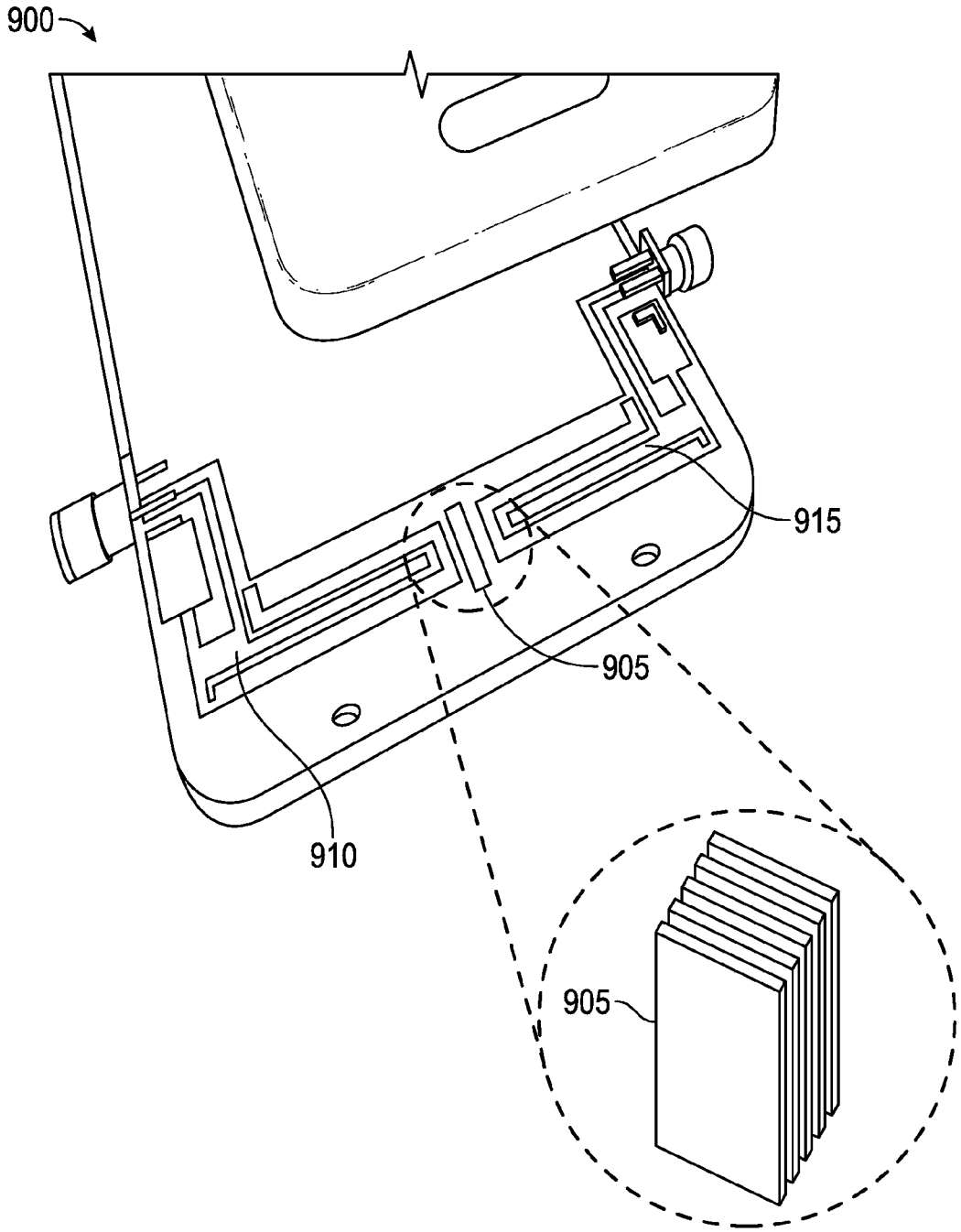
FIG. 9 depicts an ordinary planar negative uniaxial anisotropic metamaterial formed in an electronic device, in accordance with an example embodiment.

FIG. 9 illustrates a planar negative uniaxial metamaterial 905 located in a handheld device 900 in the vicinity between antenna 910 and antenna 915 (essentially the equivalent of what is shown in FIG. 3), in accordance with an example embodiment. It should be appreciated that the shape of negative uniaxial metamaterial 905 is exemplary and other shapes might alternatively be necessary according to the arrangement of potentially interfering elements in the device 900.

Figure 10:
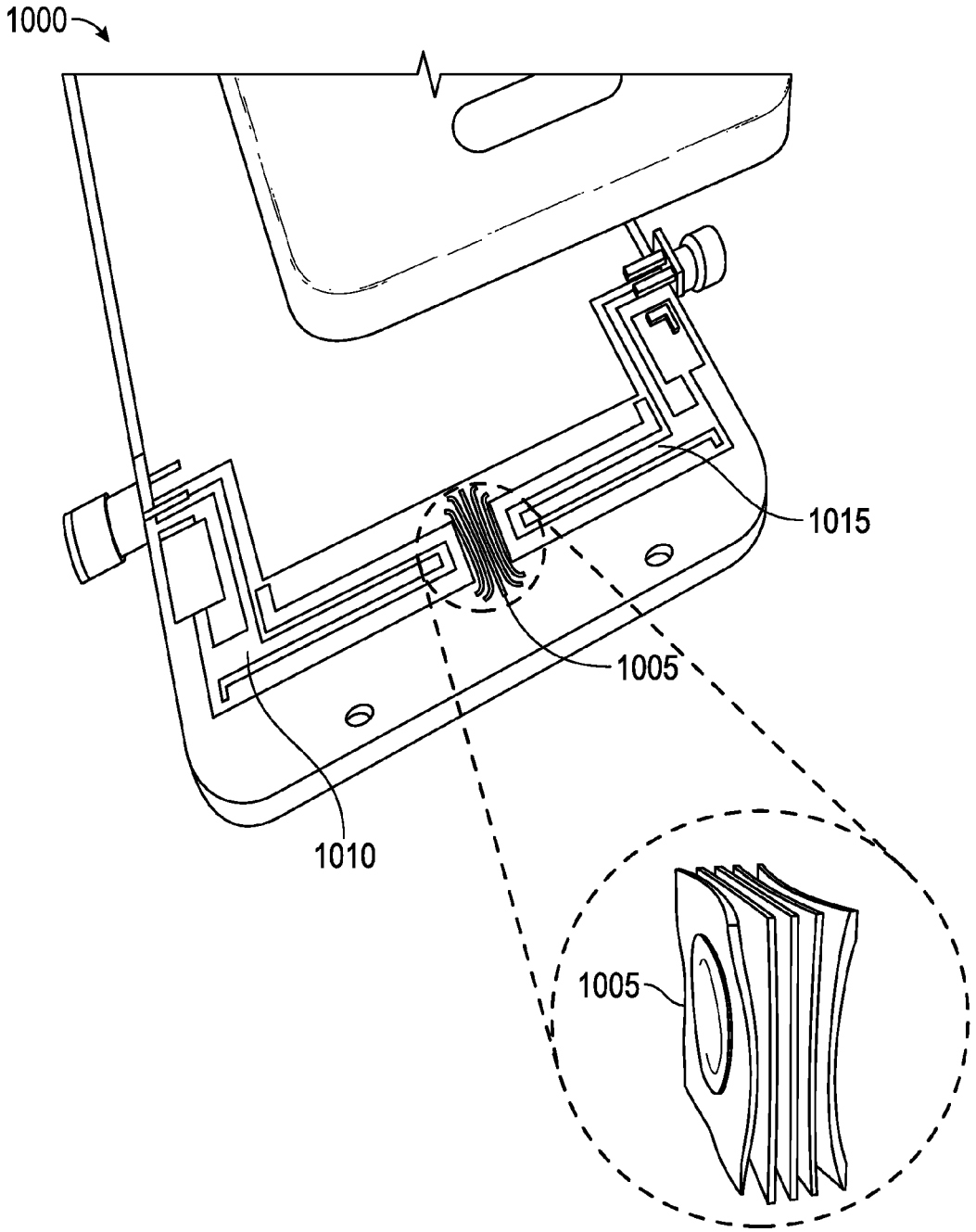
FIG. 10 depicts a spatially-variant anisotropic metamaterial formed in an electronic device, in accordance with an example embodiment.

In another example embodiment illustrated in FIG. 10, a spatially-variant anisotropic metamaterial 1005 can be generated according to the method shown in FIG. 4. The spatially-variant anisotropic metamaterial 1005 can be directly incorporated between electromagnetic element 1010 and electromagnetic element 1015 in a cell phone 1000 (or radio, tablet computer, computer, smartwatch, or other such device). FIG. 10 illustrates the incorporation of an SVAM in a cell phone 1000. Again, the SVAM is located only in the region between, outside, or otherwise around the electromagnetic elements 1010 and 1015, and it is spatially-varied to conform to physical shape of the components. The SVAM shown is essentially equivalent to the shape shown in FIG. 8.

Figure 11:
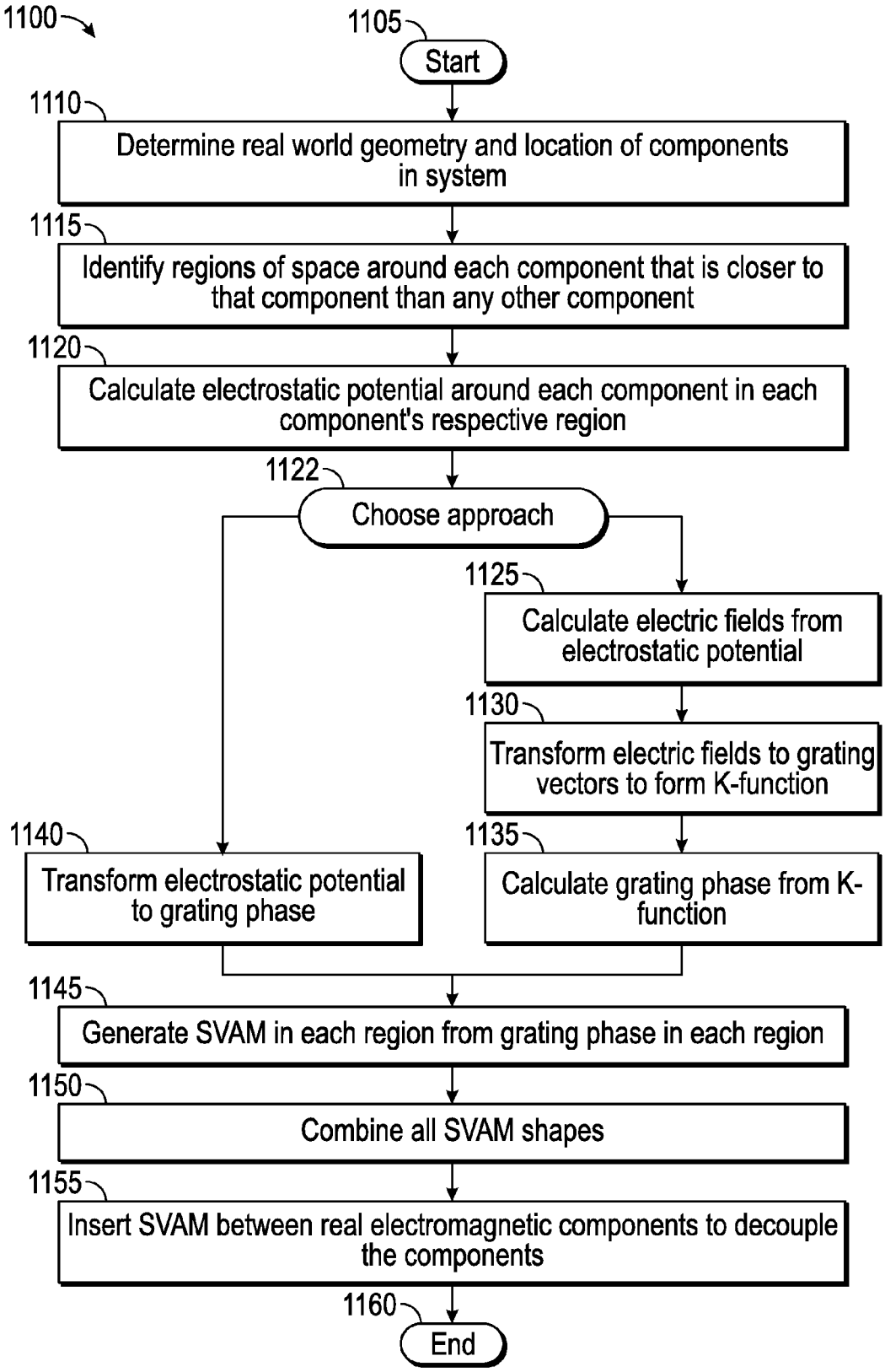
FIG. 11 depicts a flow chart of steps associated with a method for reducing coupling between multiple components in accordance with an example embodiment.

In another example embodiment, the methods and systems illustrated above can be extended to situations involving an arbitrary (i.e., more than two) number of electromagnetic, or otherwise potentially interfering, components. For applications involving multiple components, a method 1100 for reducing coupling between the components is illustrated in FIG. 11. The method begins as shown at block 1105.

Figure 12A:
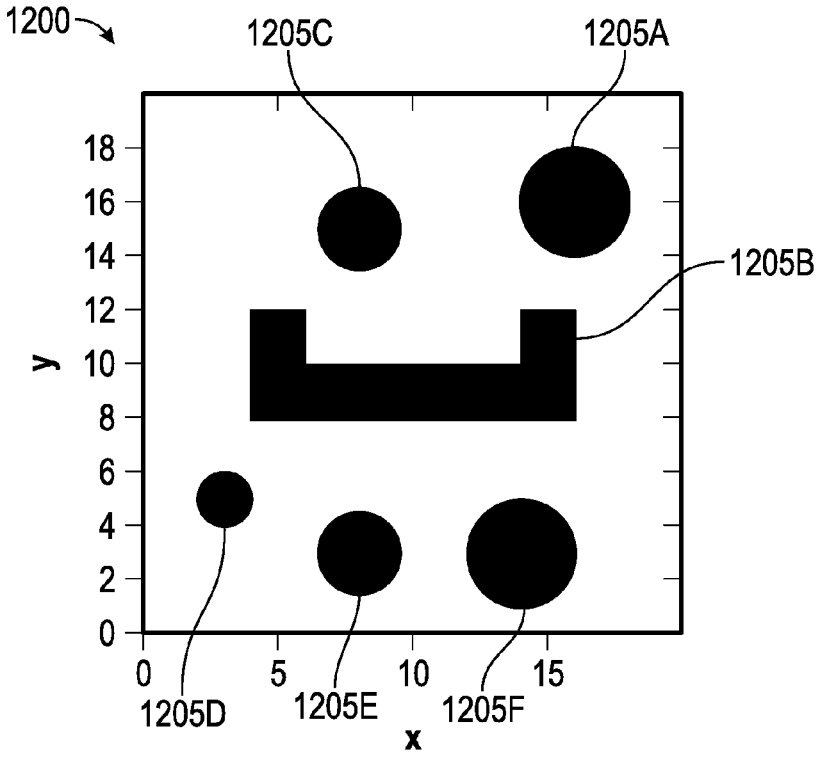
FIG. 12A depicts a plurality of components located in an environment, in accordance with an example embodiment.

FIG. 12A illustrates an environment 1200 where a number of components 1205A-F of varying shapes and sizes are located. The components 1205A-F represent any type of electronic, magnetic, electromagnetic, or metallic component disposed in the environment 1200. It should be noted that the number, shapes, and sizes of the sources shown in FIG. 12A are exemplary and are not meant to limit the scope of the invention. The environment 1200 surrounding sources 1205A-F in FIG. 12A is not specifically defined, but could be any electronic device, magnetic device, electromagnetic device, or an environment wherein several such devices are located. It is first necessary to define, import, or otherwise determine the geometry and position of the multiple components 1205A-F in the environment 1200 as shown at block 1110 of method 1100.

Figure 12B:
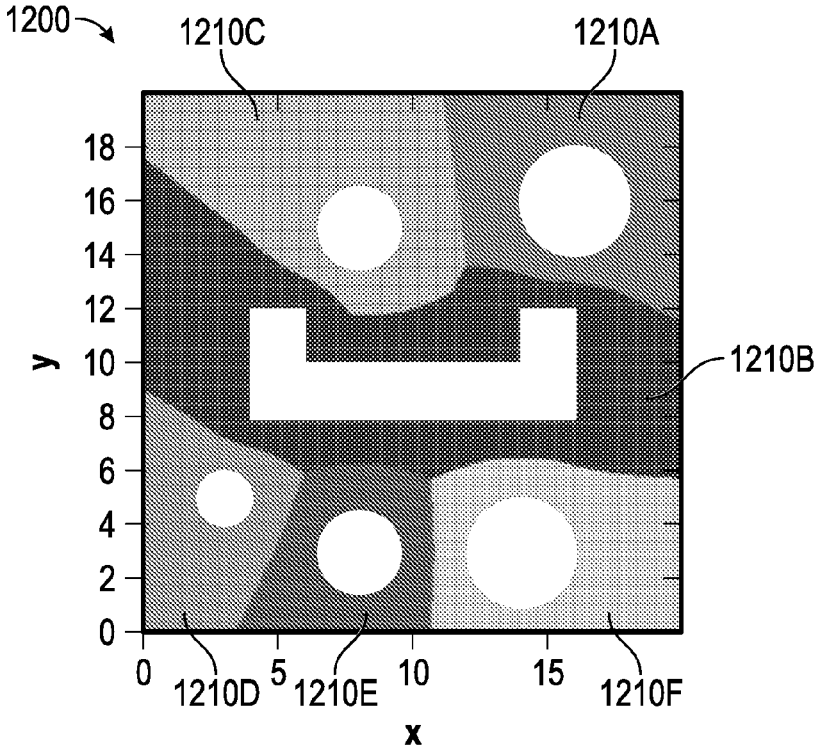
FIG. 12B depicts a plurality of regions surrounding sources located in an environment, in accordance with an example embodiment.

The region of space 1210A-F around each component that is closer to that component than to any other component can be identified as indicated at block 1115 of method 1100. FIG. 12B illustrates such an identification for the sources 1205A-F from FIG. 12A, with the corresponding spaces 1210A-F. An SVAM inside each space or region can be generated independently of the rest as long as the regions are constructed correctly. This enables the embodiment to be parallelized in a computer algorithm to accommodate rapid SVAM design for large, multi-component systems.

At block 1120, a fictitious electrostatic model of each source 1205A-F in each region 1210A-F can be independently generated, including calculation of the electrostatic potential around each component in each component's respective region. The electric potential can be forced to 0 at the interfaces of each of the regions 1210A-F (defined, for example, in FIG. 12B) and forced to 1 at the components 1205A-F themselves.

Figure 13:
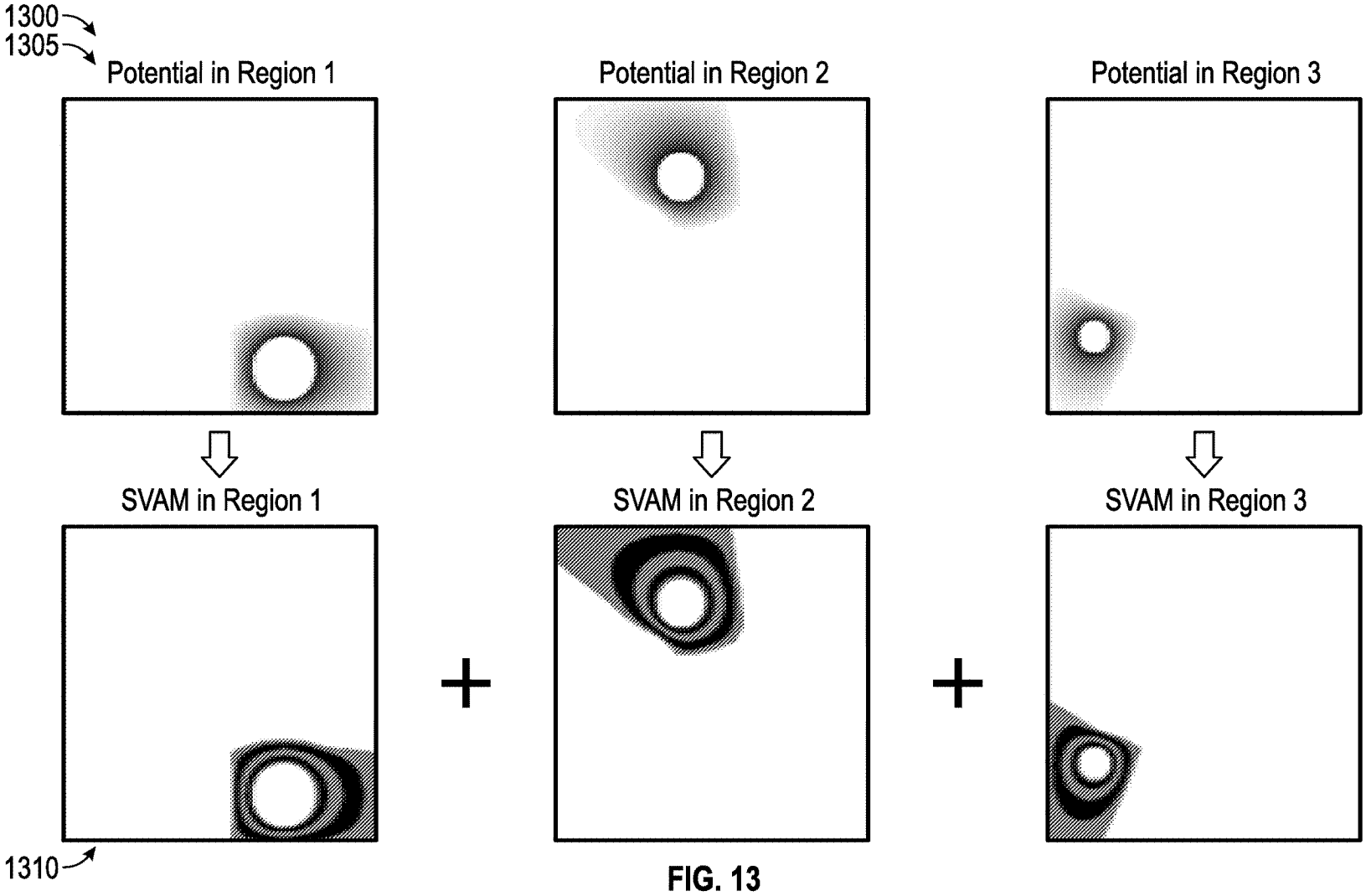
FIG. 13 depicts an electric potential and associated SVAM shapes for a plurality of sources within their regions located in an environment and the final spatially-variant anisotropic metamaterial, in accordance with an example embodiment.
Figure 13:
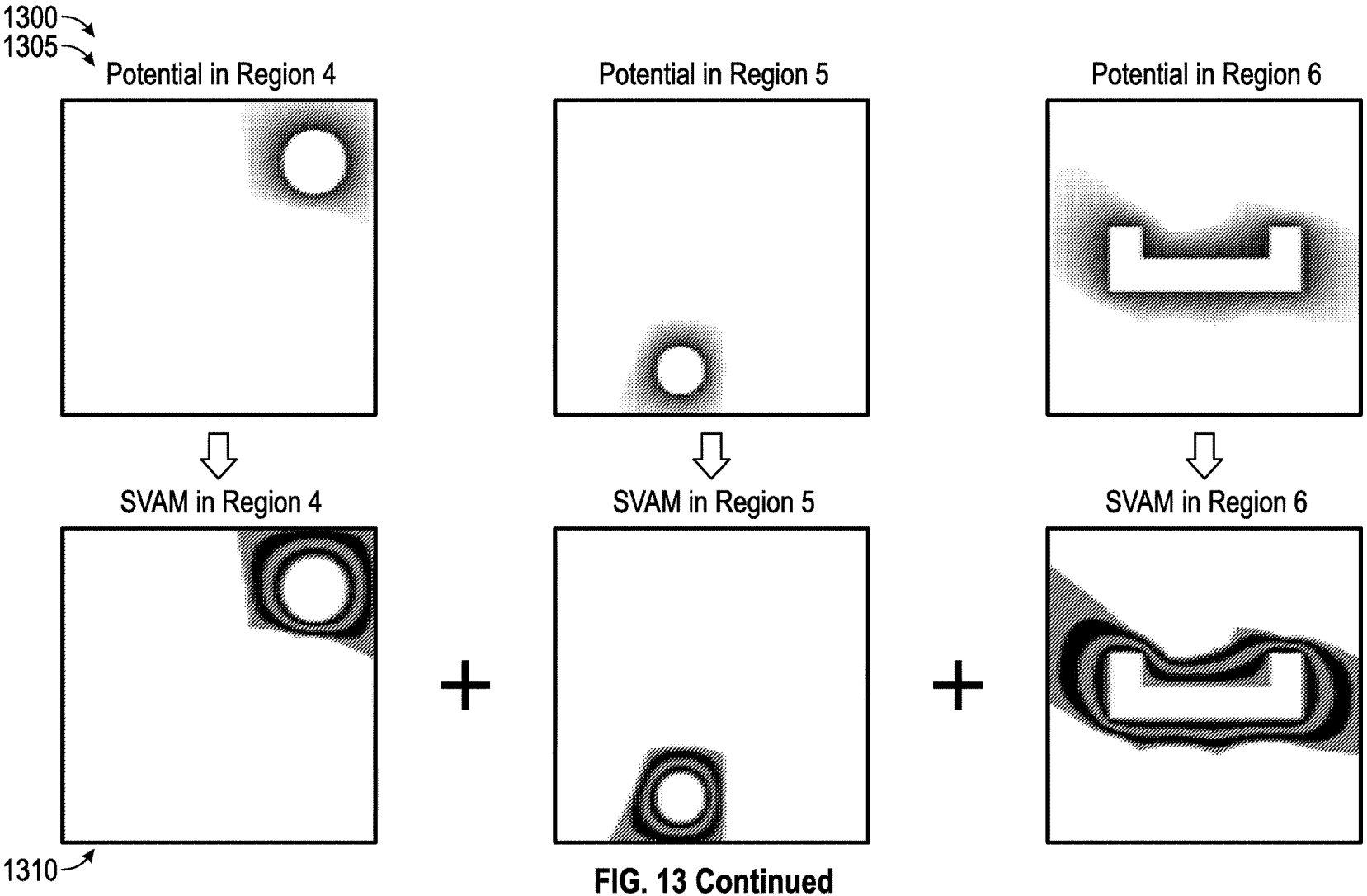
Figure 13:
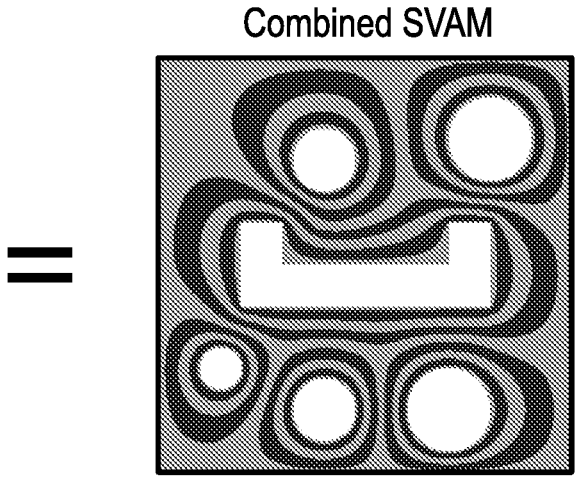

FIG. 13 illustrates a diagram 1300 of electric potential. Partition 1305 in FIG. 13 shows the electric potential calculated, as described above, around each component 1205A-F shown in FIG. 12A, within its respective region 1210A-F shown in FIG. 12B.

As in the case of two components shown in FIG. 11 at block 1122, alternative approaches may be pursued. In one embodiment, electric fields can be calculated from the electrostatic potentials as shown at block 1125. At block 1130, the electric fields can be transformed to grating vectors in order to form the K-function. The grating phase can then be calculated form the K-function as shown at block 1135.

Alternatively at block 1140, the electrostatic potential can be directly transformed to the grating phase. In an embodiment, the electric potential itself can be rescaled and used as the grating phase. In this embodiment, the SVAM can be generated directly from the fictitious scalar potential V as cos(aV) where V is scaled by some constant a in order to control the number of planar gratings generated within that space. The resulting SVAM may not be of as high quality, but this alternative embodiment may be faster and more efficient, and therefore preferred in certain circumstances where speed and efficiency are necessary.

In both alternative approaches, the next step involves generating the shape of the SVAM for each region 1210A-F, as shown at block 1145. This operation can be accomplished after determining the electric potential, calculating the vector electric field, rescaling the electric field to be the K-function, and calculating the grating phase from the K-function. The desired shape of the SVAM can be calculated from the grating phase. These operations may be achieved using a computer and computer program. Again, this is all performed in each region 1210A-F separately and independently. The partitions 1310 of diagram 1300 in FIG. 13 shows the separate SVAMs generated for each partition 1305 (the partition directly above) around each source independently.

As indicated at block 1150, all of the individual SVAM shapes determined according to the preceding operations depicted in method 1100 can be combined into one overall SVAM. This ensures the overall SVAM is smooth, continuous, and free of defects that would otherwise cause problems. An example combination of SVAMs 1400 for the components 1205A-F shown in FIG. 12A is provided in FIG. 14. Finally, as depicted at block 1155, the SVAM can be fabricated (for example, using 3D printing technology or other such digital manufacturing) in the shape determined at block 1135 and inserted into the real world environment 1200 to reduce coupling between the components 1205A-F. The method can then end as illustrated at block 1160.

Figure 14:
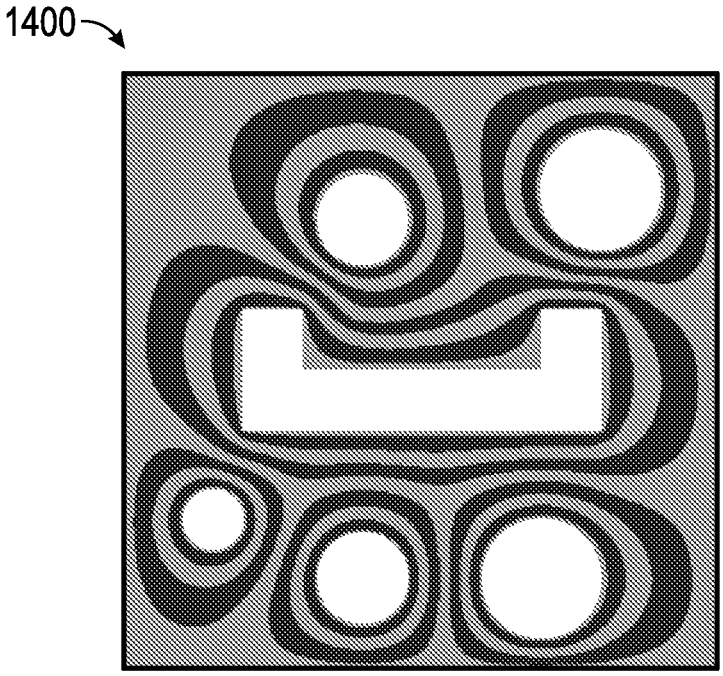
FIG. 14 depicts an SVAM for a plurality of components located in an environment, in accordance with an example embodiment.

The method used to generate FIG. 14, and thus the shape of the SVAM 1400 can use the finite-difference method.

However, this approach may not be optimal for curved geometries, which require corrections for numerical issues. In one embodiment, a computer-implemented tool can be utilized which incorporates the finite element method, and can be more easily compatible with components imported from CAD packages. This provides a different, and potentially superior, means for performing the calculations described herein, depending on application parameters.

According to the disclosures herein, embodiments may further be directed to methods and systems for using anisotropy and gradients to sculpt EM fields around devices. This may include combining permeability and permittivity. It should be appreciated that SVAMs described herein may be composed of just a permeability, and/or both permittivity and permeability can be utilized. Material gradients may also be utilized.

In other example embodiments, SVAMs may be generated directly from an electrostatic potential (e.g., the circumventing E-field, and K-function).

In other example embodiments, positive uniaxial metamaterials for both decoupling and enhanced coupling may be utilized. For example, in some embodiments, negative uniaxial materials are used for reducing electromagnetic coupling and positive uniaxial materials are used for enhancing electromagnetic coupling, but it should be understood there are some situations where the opposite can be true.

Anisotropy may be taken advantage of for various purposes including using metamaterials to produce the anisotropy. This may include all-dielectric metamaterials (but metal can still be used). Further, the invention could be implemented with magnetic materials instead of dielectric.

Some example embodiments may utilize an array of high-permittivity rods in a low-permittivity background. This example embodiment can include the use of material gradients and more specifically spatially-varying the anisotropy/gradients to sculpt fields. This example embodiment may be accomplished utilizing spatially-variant synthesis tools.

Embodiments disclosed herein may be utilized for sculpting fields to improve EMC (Electromagnetic Compatibility). This can improve EMC of antennas, and in particular, antennas in proximity to metals or other components or antennas in proximity to other antennas.

Field sculpting may also be used to design antennas, such as MIMO antennas, and phased array antennas. Field sculpting is also applicable in conjunction with other RF components such as filters, couplers, transmission lines, vertical interconnects, etc.

In other example embodiments, field sculpting may alternatively be used to increase coupling. This may be advantageous in all-dielectric interconnects, anti-reverse engineering, in new mechanisms for filtering, to facilitate more compact components like couplers, for sculpting fields to improve performance of components forced to work in awkward form factors, for antennas such as unfolding antennas, and in other such components.

The methods and systems disclosed herein may be utilized to produce sculpted dielectrics, electrostatic models followed by spatially-variant algorithms, and other planar gratings.

Note that in some embodiments, computer program code for carrying out operations of the disclosed embodiments may be written in an object oriented programming language (e.g., Python, Java, C#, C++, etc.). Such computer program code, however, for carrying out operations of particular embodiments can also be written in conventional procedural programming languages, such as the "C" programming language or in a visually oriented programming environment, such as, for example, MATLAB or Visual Basic. Similarly computer aided drafting software may be used in certain embodiments.

The program code may execute entirely on the user's computer, partly on the user's computer, as a stand-alone software package, partly on the user's computer and partly on a remote computer, or entirely on the remote computer. In the latter scenario, the remote computer may be connected to a user's computer through a local area network (LAN) or a wide area network (WAN), wireless data network e.g., Wi-Fi, Wimax, IEEE 802.xx, and cellular network, or the connection may be made to an external computer via most third party supported networks (e.g., through the Internet via an Internet Service Provider).

The embodiments are described at least in part herein with reference to flowchart illustrations and/or block diagrams of methods, systems, and computer program products and data structures according to embodiments of the invention. It will be understood that each block of the illustrations, and combinations of blocks, can be implemented by computer program instructions. These computer program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the block or blocks.

These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the various block or blocks, flowcharts, and other architecture illustrated and described herein.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the block or blocks.

Figure 15:
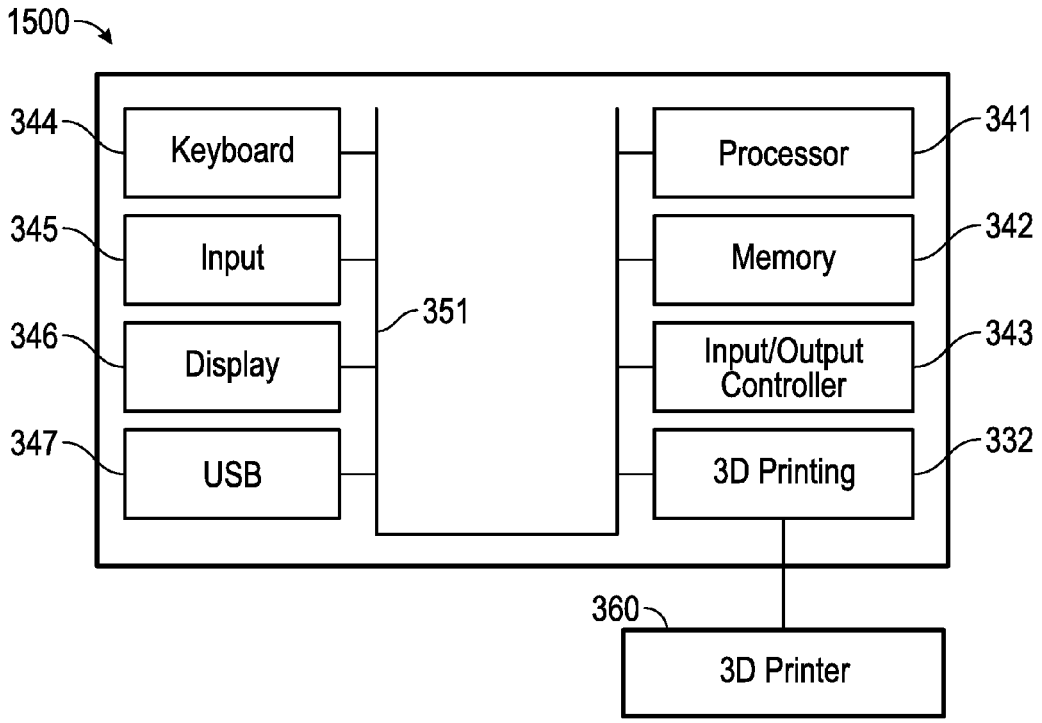
FIG. 15 illustrates a schematic view of a computer system, in accordance with an example embodiment.
Figure 16:
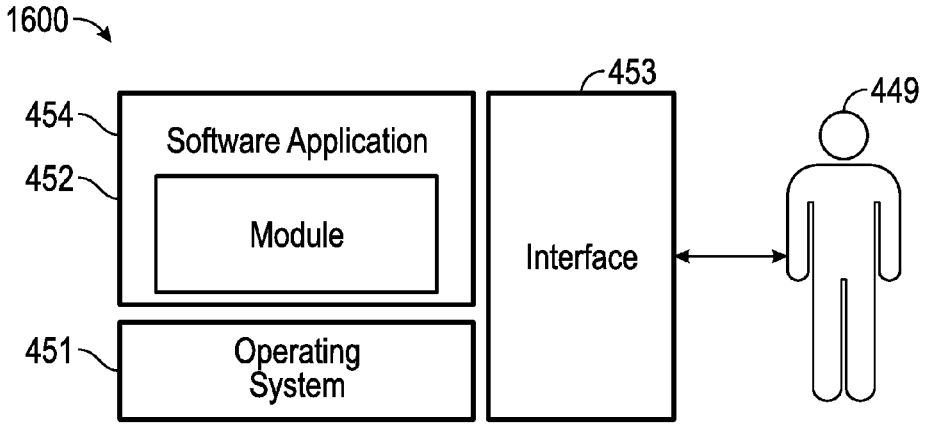
FIG. 16 illustrates a schematic view of a software system including a module, an operating system, and a user interface, in accordance with an example embodiment.

FIGS. 15-16 are provided as exemplary diagrams of data-processing environments in which embodiments may be implemented. It should be appreciated that FIGS. 15-16 are only exemplary and are not intended to assert or imply any limitation with regard to the environments in which aspects or embodiments of the disclosed embodiments may be implemented. Many modifications to the depicted environments may be made without departing from the spirit and scope of the disclosed embodiments.

As illustrated in FIG. 15, some embodiments may be implemented in the context of a data-processing system 1500 that can include one or more processors such as processor 341. The example data-processing system 1500 shown in FIG. 15 can further include a memory 342, a controller 343 (e.g., an input/output controller), a peripheral USB (Universal Serial Bus) connection 347, a keyboard 344 (e.g., a physical keyboard or a touch screen graphically displayed keyboard), an input component 345 (e.g., a pointing device, such as a mouse, track ball, pen device, which may be utilized in association or with the keyboard 344, etc.), a display 346, and in some cases, a peripheral connection 332 to a 3D printer 360.

In some example embodiments, data-processing system 1500 may be a client computing device (e.g., a client PC, laptop, tablet computing device, etc.), which communicates with peripheral devices (not shown) via a client-server network (e.g., wireless and/or wired). In another example embodiment, the data-processing system 1500 may be a server in the context of a client-server network or other server-based network implementation.

As illustrated, the various components of data-processing system 1500 can communicate electronically through a system bus 351 or other similar architecture. The system bus 351 may be, for example, a subsystem that transfers data between, for example, computer components within data-processing system 1500 or to and from other data-processing devices, components, computers, etc. Data-processing system 1500 may be implemented as, for example, a server in a client-server based network (e.g., the Internet) or can be implemented in the context of a client and a server (i.e., where aspects are practiced on the client and the server). In some example embodiments, data-processing system 1500 may be, for example, a standalone desktop computer, a laptop computer, a Smartphone, a pad computing device, a server, and so on.

FIG. 16 illustrates a computer software system 1600 for directing the operation of the data-processing system 1500 shown in FIG. 15. Software application 454 stored, for example, in memory 342, generally includes a kernel or operating system 451 and a shell or interface 453. One or more application programs, such as software application 454, may be "loaded" (i.e., transferred from, for example, memory 342 or another memory location) for execution by the data-processing system 1500. The data-processing system 1500 can receive user commands and data through the interface 453; these inputs may then be acted upon by the data-processing system 1500 in accordance with instructions from operating system 451 and/or software application 454. The interface 453, in some embodiments, can serve to display results, whereupon a user 449 may supply additional inputs or terminate a session.

The software application 454 can include one or more modules such as, for example, a module 452, which can, for example, implement instructions or operations/steps such as those described herein. Examples of instructions that can be implemented by module 452 include steps or operations such as those shown and described herein with respect to blocks 405, 410, 415, 420, 425, 430, 435, 440, 445, and 450 of FIG. 4 and blocks 1105, 1110, 1115, 1120, 1122, 1125, 1130, 1135, 1140, 1145, 1150, 1155, and 1160 of FIG. 11.

The following discussion is intended to provide a brief, general description of suitable computing environments in which the system and method may be implemented. Although not required, the disclosed embodiments will be described in the general context of computer-executable instructions, such as program modules, being executed by a single computer. In most instances, a "module" such as module 452 shown in FIG. 16 constitutes a software application. However, a module such as module 452 may also be composed of, for example, electronic and/or computer hardware or such hardware in combination with software. In some cases, a "module" can also constitute a database and/or electronic hardware and software that interact with such a database.

Generally, program modules include, but are not limited to, routines, subroutines, software applications, programs, objects, components, data structures, etc., that perform particular tasks or implement particular abstract data types and instructions. Moreover, those skilled in the art will appreciate that the disclosed method and system may be practiced with other computer system configurations, such as, for example, hand-held devices, multi-processor systems, data networks, microprocessor-based or programmable consumer electronics, networked PCs, minicomputers, mainframe computers, servers, and the like.

Note that the term module as utilized herein can refer to a collection of routines and data structures that perform a particular task or implement a particular abstract data type. Modules may be composed of two parts: an interface, which lists the constants, data types, variable, and routines that can be accessed by other modules or routines; and an implementation, which is typically private (accessible only to that module) and which includes source code that actually implements the routines in the module. The term module may also simply refer to an application, such as a computer program designed to assist in the performance of a specific task, such as word processing, accounting, inventory management, etc.

FIGS. 15-16 are thus intended as examples and not as architectural limitations of disclosed embodiments. Additionally, such embodiments are not limited to any particular application or computing or data processing environment. Instead, those skilled in the art will appreciate that the disclosed approach may be advantageously applied to a variety of systems and application software. Moreover, the disclosed embodiments can be embodied on a variety of different computing platforms, including, for example, Windows, Macintosh, UNIX, LINUX, and the like.

It will be appreciated that variations of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art, which are also intended to be encompassed by the following claims.

What is claimed is:

1. A system comprising:

at least two components coupled through an electromagnetic field; and at least one all-dielectric metamaterial configured to reduce coupling between said at least two components, wherein the at least one all-dielectric metamaterial is formed according to at least one grating vector function, the grating vector function comprising a scaling of the electromagnetic field.

2. The system of claim 1, wherein said at least one all-dielectric metamaterial is spatially-variant to conform around said at least two components.

3. The system of claim 1, wherein said at least one all-dielectric metamaterial comprises a negative uniaxial anisotropic metamaterial.

4. The system of claim 1, wherein said at least one all-dielectric metamaterial is configured in a shape selected according to the electromagnetic field.

5. The system of claim 1, wherein said at least one all-dielectric metamaterial is configured in a shape selected according to an electrostatic model using the at least two components.

6. The system of claim 4, further comprising:

an array of all-dielectric metamaterials including said at least one all-dielectric metamaterial, wherein said array of all-dielectric metamaterials is formed to decouple said at least two components coupled through said electromagnetic field.

7. The system of claim 6, wherein said array of all-dielectric metamaterials is formed in space separating said at least two components.

8. The system of claim 1, wherein the at least one all-dielectric metamaterial is monolithic.

9. The system of claim 1, wherein the at least one all-dielectric metamaterial is electromagnetically operable in a non-resonant mode.

10. The system of claim 1, wherein the at least one all-dielectric metamaterial is operable at a defined frequency having a corresponding free-space wavelength λ, and wherein a spacing between proximately disposed ones of the at least one all-dielectric metamaterial is equal to or less than one-quarter λ.

11. The system of claim 1, wherein each component of the at least two components comprises an antenna.

12. The system of claim 1, wherein at least a portion of each material of the at least one all-dielectric metamaterial is oriented perpendicular to a z-axis of an orthogonal x, y, z coordinate system, and wherein the z-axis defines a direction of separation between two of the at least two components.

13. A method for decoupling electromagnetic components, the method comprising:

defining a design for at least one all-dielectric metamaterial, wherein an electromagnetic field is determined in a space between each of said electromagnetic components disposed in an environment;

forming at least one all-dielectric metamaterial according to at least one grating vector function; and inserting said at least one all-dielectric metamaterial in the environment in order to decouple said electromagnetic components.

14. The method of claim 13, wherein defining a design for at least one all dielectric metamaterial comprises:

transforming the electromagnetic field into said at least one grating vector function.

15. The method of claim 13, wherein defining a design for said at least one all-dielectric metamaterial comprises:

determining an electrostatic potential.

16. The method of claim 13, wherein the least one grating vector function comprises a scaling of an electromagnetic field.

17. The method of claim 13, further comprising:

determining an electromagnetic field associated with an assembly of components disposed in said environment; and creating an electrostatic model according to said electromagnetic components.

18. The method of claim 13, wherein forming said at least one all-dielectric metamaterial according to the at least one grating vector function further comprises:

defining a shape and a spacing of said at least one all-dielectric metamaterial according to the at least one grating vector function.

19. The method of claim 13, wherein said at least one all-dielectric metamaterial comprises a spatially-variant anisotropic all-dielectric metamaterial.

20. The method of claim 13, wherein said at least one all-dielectric metamaterial comprises a negative uniaxial spatially-variant anisotropic all-dielectric metamaterial.

21. A system comprising:

at least two components coupled through an electromagnetic field; and at least one all-dielectric metamaterial formed in a space separating said at least two components and configured in a shape selected according to an electromagnetic field causing coupling between the at least two components, wherein the shape is configured to reduce said coupling between the at least two components, and the at least one all-dielectric metamaterial is formed according to at least one grating vector function, wherein the grating vector function comprises a scaling of the electromagnetic field.

22. The system of claim 21, wherein said at least one all-dielectric metamaterial is spatially-variant to conform around said at least two components.

23. The system of claim 21, wherein said at least one all-dielectric metamaterial comprises a negative uniaxial anisotropic all-dielectric metamaterial.

24. The system of claim 21, wherein said at least one all-dielectric metamaterial is configured in a shape selected according to a electrostatic model utilizing said components causing the coupling between the at least two components.

25. The system of claim 21, further comprising:

an array of all-dielectric metamaterials formed to decouple said at least two components coupled through said electromagnetic field, said array of all-dielectric metamaterials includes said at least one all-dielectric metamaterial.

* * * * *